US005687814A

United States Patent [19]

Craig et al.

[11] Patent Number: 5,687,814

[45] Date of Patent: Nov. 18, 1997

[54] ASSEMBLY FOR APPLYING ONE OR MORE MATERIALS TO A RAIL

[75] Inventors: Jeffrey P. Craig, Monroeville; William T. Urmson, Jr., Valencia, both of Pa.; Dennis Bell, Steelville, Mo.

[73] Assignee: Portec Inc., RMP Division, Pittsburgh, Pa.

[21] Appl. No.: 499,322

[22] Filed: Jul. 7, 1995

[51] Int. Cl.[6] ..... B61K 3/02

[52] U.S. Cl. ..... 184/3.2; 184/6.4; 184/6.28; 184/108; 248/220.22; 248/223.31; 248/224.61; 248/287.1; 403/107; 403/110

[58] Field of Search ..... 184/2, 3.1, 3.2, 184/6.4, 6.28, 108; 248/220.22, 223.31, 223.41, 224.61, 287.1; 403/104, 106, 107, 110, 382

[56] References Cited

U.S. PATENT DOCUMENTS

| | | | |
|---|---|---|---|
| 791,640 | 6/1905 | Miner | 184/3.2 |
| 1,099,631 | 6/1914 | Alexander . | |
| 1,497,177 | 6/1924 | Long | 184/3.2 |
| 1,701,506 | 2/1929 | Reid . | |
| 1,885,726 | 11/1932 | Isabella . | |
| 2,106,924 | 2/1938 | Guffra | 184/3.2 |
| 2,184,969 | 12/1939 | Allen . | |
| 2,223,714 | 12/1940 | Bates et al. . | |
| 2,231,394 | 2/1941 | Reece . | |
| 2,518,786 | 8/1950 | Huck . | |
| 2,602,694 | 7/1952 | Richardson . | |
| 2,884,093 | 4/1959 | Stewart . | |
| 2,935,159 | 5/1960 | Burrell | 184/3.2 |
| 3,542,153 | 11/1970 | Phillips et al. . | |
| 3,730,297 | 5/1973 | Colgan et al. | 184/6.4 |
| 3,937,596 | 2/1976 | Braidwood . | |
| 4,214,647 | 7/1980 | Lutts | 184/6.4 |
| 4,334,596 | 6/1982 | Lounsberry, Jr. . | |
| 4,372,285 | 2/1983 | Simonds et al. | 403/110 |
| 4,736,818 | 4/1988 | Wolfe . | |
| 4,856,617 | 8/1989 | Lounsberry, III et al. . | |
| 4,930,600 | 6/1990 | Kumar et al. | 184/3.2 |
| 5,076,396 | 12/1991 | Foote . | |
| 5,213,697 | 5/1993 | Vinci et al. . | |
| 5,236,063 | 8/1993 | Nelson et al. . | |
| 5,348,120 | 9/1994 | Junk et al. . | |
| 5,394,958 | 3/1995 | Junk et al. . | |

FOREIGN PATENT DOCUMENTS 3214149 11/1983 Germany .

*Primary Examiner*—Christopher Verdier
*Attorney, Agent, or Firm*—Webb Ziesenheim Bruening Logsdon Orkin & Hanson, P.C.

[57] ABSTRACT

An assembly for applying one or more materials to the rails of a railroad track includes a mounting bracket for mounting the assembly to a vehicle adapted to travel on the rails. A connecting arm is coupled to the mounting bracket, and at least one nozzle is connected to an end of the connecting arm. The nozzle arm has a hollow channel through which material flows to be applied to a rail surface. A nozzle port is in fluid communication with the nozzle channel when the nozzle arm is in an operative position. The nozzle arm is biased toward the operative position and is adapted to move away from the operative position in response to contact with an obstruction and is returned to the operative position following the contact.

33 Claims, 6 Drawing Sheets

ASSEMBLY FOR APPLYING ONE OR MORE MATERIALS TO A RAIL

BACKGROUND OF THE INVENTION

1. Field of the Invention

The present invention relates to an apparatus for applying a material to the rails of a railroad or similar track, and more particularly, to an inventive assembly adapted to be included with a mobile track vehicle device which serves to apply the material to the rails of a railroad or similar track.

2. Background Information

It is a common practice to apply materials, including but not limited to, a lubricant to the rails of a railroad track or to the wheels of trains and other rolling stock. Lubricant is applied to prevent wear and squealing noises while a train is traversing a curve. Oscillations of high frequency make annoying sounds which occur due to the twisting of the wheel axle and subsequent release of that twist as the curved rail is negotiated. This is particularly true for solid two wheel axle units, which is due to the difference in length of the outer and inner track of the curve. Applying lubricant to the wheel/rail interface reduces or eliminates the wear and squealing noises described above. In addition, applying lubricant to the wheel/rail interface substantially reduces wear of the rails and wheels, which in turn, extends useful life and reduces repair/replacement costs. Further, applying lubricant to the wheel/rail interface results in fuel savings for the vehicles negotiating such rails.

Existing arrangements for supplying lubricant to the wheel/rail interface include the use of a wayside grease box with a distribution manifold where a lubricant consisting of semi-solid grease is pumped onto the rails as the train crosses an actuator, whereupon the wheels carry the grease into the curve. Examples include U.S. Pat. Nos. 2,223,714; 2,231,394; 2,518,786; 2,884,093; 4,334,596; 4,856,617; 5,348,120; and 5,394,958. A limitation with this system is that the grease is spread over a large area, including around the rails, ties, ballast, wayside devices and is splashed onto rolling stock. A further limitation is that such systems require complex pumping and actuating devices to deliver the grease to the rail. Yet another limitation is that each curve that requires lubrication must be equipped with a separate lubricating device, and a large number of lubricators are thus required along a given stretch of track.

With the limitations associated with wayside grease boxes, various types of mobile lubricating units have been developed. Such mobile lubricating units have in common the fact that they are mounted on vehicles which traverse the rails, dispensing lubricant on the rail as the vehicle travels along the rail. Examples include U.S. Pat. Nos. 4,736,818 and 5,236,063. In some instances, the vehicle equipped with the mobile lubricating unit is dedicated solely to lubricating the rail. In other instances, the mobile lubricating unit is an adjunct to a vehicle traveling the rail for other purposes such as rail inspection or maintenance.

Several mobile lubricating units, including those described in U.S. Pat. Nos. 4,736,818 and 5,236,063 include nozzles through which the lubricant flows onto the side of the rail, more accurately referred to as the gauge face of the rail. These nozzles may be raised and lowered with pneumatic cylinders as described in U.S. Pat. No. 4,736,818. Alternatively, these nozzles can be incorporated as part of the rail gear of the vehicles and will be in a rail lubricating position only when the rail gear is in its lowered position as described in U.S. Pat. No. 5,236,063. One important limitation of both systems described in U.S. Pat. Nos. 4,736,818 and 5,236,063 is that neither system is able to account for objects or obstructions in the nozzle arm's path as it proceeds along the rail. Such objects include frogs, crossings or debris along the rail. Consequently, when such objects strike the nozzle arms of the prior art, the nozzle arms are often displaced accidentally and permanently, resulting in the wasting of grease which is no longer dispensed where desired, and further requiring repair costs and downtime inconvenience to repair the bent or broken nozzle arm assembly.

Even where pneumatic control over the nozzle's orientation with respect to the rail is present, as in U.S. Pat. No. 4,736,818, an operator is still required to cause the pneumatic control to lift the nozzle to insure that the nozzles are not damaged or bent by objects in the rail path. This requires the operator to both see the object in the rail path and react quickly enough to prevent damage to the nozzle or nozzle arm.

Still another limitation with the above-described rail lubrication nozzle assemblies is that each are able only to lubricate the rail gauge face. In some applications, it is desirable to apply a material such as a lubricant to the top of the rail or simultaneously to the top of the rail and the rail gauge face. Different materials include lubricants, anti-slip compounds, friction modifiers, rail cleaners or degreasers or other materials. This is simply not possible with assemblies known in the art.

A need exists in the art for an assembly for applying one or more materials to a rail which does not suffer from the above-described limitations, and is easily able, without operator intervention, to negotiate objects in the rail path. A further need exists in the art for an assembly for applying one or more materials to a rail which can be adapted to existing mobile systems which is easily able, without operator intervention, to negotiate objects in the rail path. An additional need exists in the art for an assembly for applying one or more materials to a rail which can apply a desired material to both the gauge face and the top of the rail independently or simultaneously. A need also exists in the art for an assembly for applying one or more materials to a rail which is capable of applying the same or different materials to the rail gauge face and the top of the rail, simultaneously or independently.

SUMMARY OF THE INVENTION

It is an object of the present invention to provide an assembly for applying one or more materials to a rail which is adapted to be included with a mobile railed system, which does not suffer from the significant limitations associated with the above-described prior art nozzle and nozzle control systems. Namely, it is an object of the present invention to provide an assembly for applying one or more materials to a rail which can easily negotiate objects in the rail path without operator assistance and without regard to whether the vehicle which incorporates the assembly of the present invention is moving in a forward or backward direction along the rail. It is a further object of the present invention to provide an assembly for applying one or more materials to a rail which is adapted to be included with mobile railed vehicles which can negotiate an object or obstruction in the rail path immediately and without operator assistance return to a position of dispensing the material in a desired orientation with respect to the rail surface. It is a further object of the present invention to provide an assembly for applying one or more materials to a rail which is adapted to be included with a mobile railed vehicle which will immediately and without operator assistance suspend the dispensing of material to the rail surface while the assembly is negotiating objects in the rail path and is therefore not in the proper orientation with respect to the rail surface to dispense material on the rail surface where required. It is also an object of the present invention to provide an assembly for applying one or more materials to a rail, which is adapted to be included with a mobile railed vehicle which can apply the material to the gauge face, the rail top surface or simultaneously to both the rail gauge face and the rail top surface. It is also an object of the present invention to provide an assembly for applying one or more materials to a rail which is capable of applying the same or different materials to the rail gauge face and the top of the rail, simultaneously or independently, said materials including but not limited to lubricants, anti-slip materials, rail cleaners, rail degreasers or friction modifiers.

These and other objects of the present invention are obtained with the assembly for applying one or more materials to a rail of the present invention which includes:

a) a mounting bracket for mounting the assembly to a vehicle adapted to travel on the rail;

b) a connecting arm having a first and second end, the connecting arm coupled to the mounting bracket;

c) at least one nozzle arm connected to the first end of the connecting arm, the nozzle arm further including a hollow channel disposed therein through which a material to be applied to a rail surface from a material supply source flows;

d) a nozzle port in fluid communication with the nozzle arm channel through which port the material flows and is dispensed on the rail surface when the nozzle arm is in an operative position; and e) a means for biasing the nozzle arm toward the operative position, whereby the nozzle arm is adapted to move away from the operative position in response to contact with obstructions and is returned by the biasing means to the operative position following the contact.

A complete understanding of the invention will be obtained from the following description when taken in connection with the accompanying drawing figures, wherein like reference characters identify like parts throughout.

DESCRIPTION OF THE PREFERRED EMBODIMENTS

Figure 1:
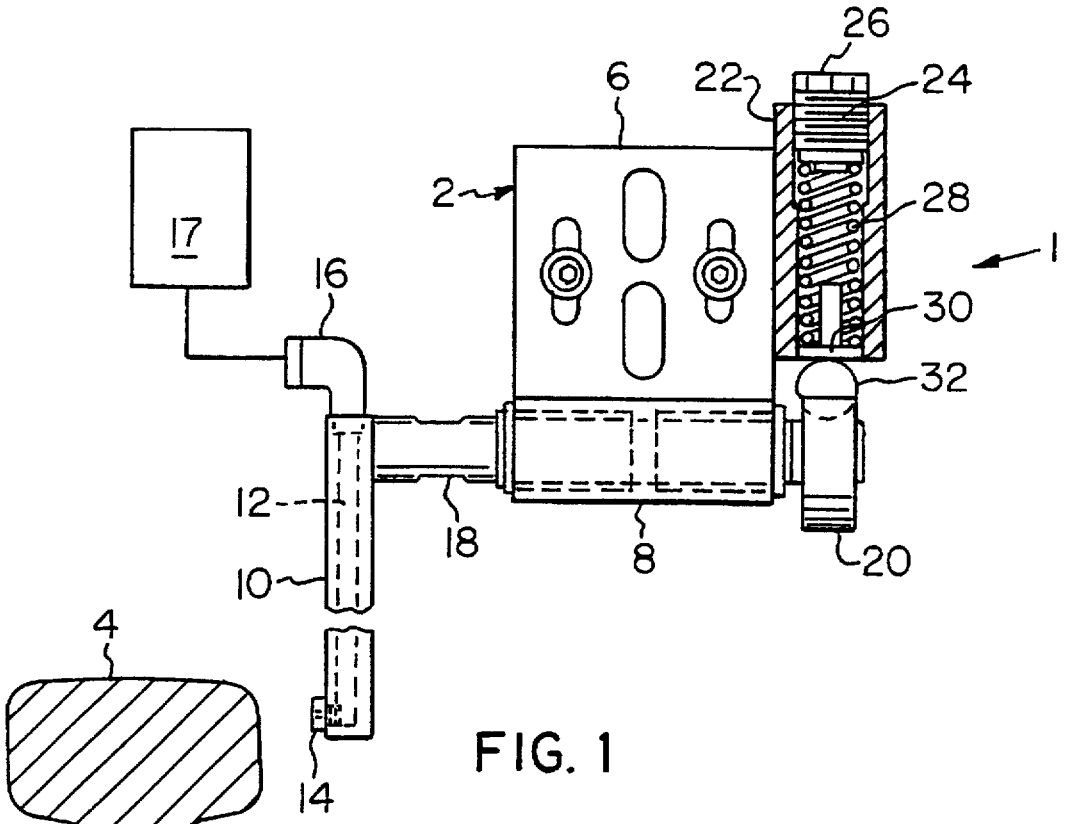
FIG. 1 is a front sectional view of the assembly for applying one or more materials to a rail of the present invention shown in position to dispense a material on a rail.

Referring to FIG. 1, the assembly 1 for applying one or more materials to a rail of the present invention is shown mounted on mounting bracket 2, whereupon it can dispense material onto rail 4, shown in cross section. Mounting bracket 2 includes a base plate 6 and sleeve 8. Base plate 6 can be formed in any manner necessary to provide for the attachment of the assembly 1 for applying one or more materials to a rail to new or existing vehicles of the type that can travel on rails to form a mobile lubrication system. The assembly 1 for applying one or more materials to a rail further includes nozzle arm 10. Nozzle arm 10 includes nozzle arm channel 12 shown in phantom, which is simply a through-hole extending along the longitudinal axis of nozzle arm 10. At a first end of channel 12, nozzle arm 10 further includes discharge port or orifice 14 and at a second end of channel 12, nozzle arm 10 includes a fitting 16 for accepting a material from a supply 17. For ease of discussion, it will be assumed the material is grease or other lubricant, but it is to be noted that the material can include any material sought to be dispensed on a rail, including lubricants, anti-slip materials, friction modifiers, rail cleaners or degreasers on other materials. Grease or other lubricant enters channel 12 through fitting 16 and proceeds through nozzle arm 10 to discharge port 14 positioned below a top surface of the rail 4 and spaced from the rail 4, whereupon it is distributed along the gauge face of rail 4. It is important to note that discharge port 14 is oriented at a 90 degree angle to the gauge face of rail 4. This is an important aspect of the present invention over prior art discharge ports that discharge at angles other than 90 degrees, typically at 45 degree angles. Ports discharging at angles other than 90 degrees result in much lost lubricant due to the fact that as the vehicle of the mobile system travels the track it sways between the rails and much lubricant completely misses the rail gauge face. The orifice 14 of the present invention discharging at a 90 degree angle to the rail gauge face ensures that lubricant is deposited on the gauge face regardless of swaying of the vehicle.

The present invention includes connecting arm 18, having a first and second end along its longitudinal axis. The first end of connecting arm 18 is attached to nozzle arm 10. The second end of connecting arm 18 is attached to a cam 20. Connecting arm 18 is retained within sleeve 8 by any means known in the art including snap rings, pins, bearings and the like, but connecting arm 18 must be free to rotate within sleeve 8. Cam 20 is generally disc-like in shape, with a generally V-shaped wedge or recess removed from its upper hemisphere. This is best shown in FIG. 2.

Figure 2:
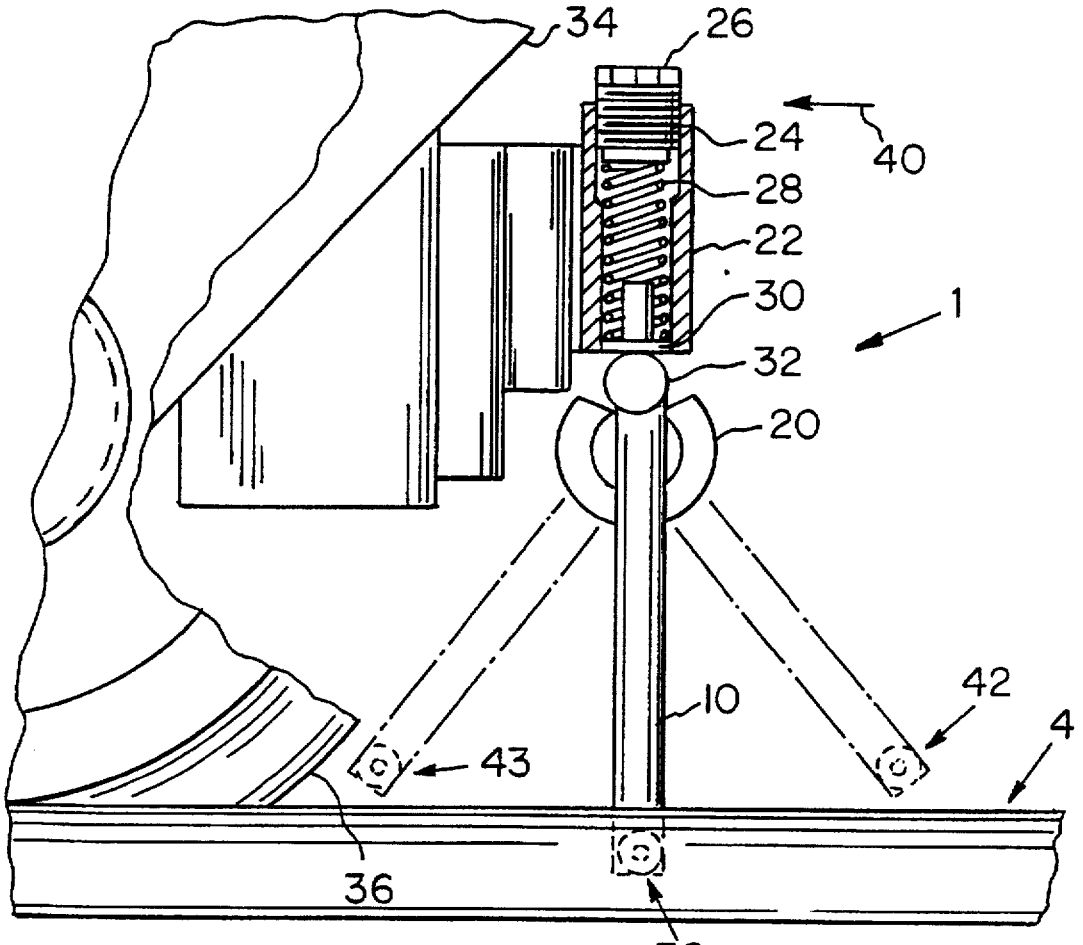
FIG. 2 is a side sectional view of a first embodiment of the assembly of the present invention.

Shown in FIGS. 1 and 2 is spring guide 22 of the present invention. Spring guide 22 is shown in FIGS. 1 and 2 vertically above the recess of cam 20, but it is to be understood that if the recess on cam 20 were positioned at another point than the upper hemisphere of cam 20, such as, for example, on the left or right hemisphere of cam 20, spring guide 22 would likewise be positioned on the left or right side of cam 20 above the recess of cam 20. Spring guide 22 is generally tubular with a hollow longitudinal channel therein, and includes threads 24 on its end furthest from cam 20 into which a spring tension adjuster 26 is threadably engaged. A spring 28 is retained within spring guide 22 and urges at a first end against spring tension adjuster 26 and at a second end against a plate 30. Rotation of spring tension adjuster 26 within threads 24 will correspondingly increase or decrease the tension provided by spring 28. A centering ball or detent 32 is maintained between cam 20 and plate 30.

In operation, as shown in FIG. 2, when nozzle arm 10 of the assembly 1 for applying one or more materials to a rail, shown attached in FIG. 2 to rail gear 34, which is, in turn, shown attached to wheel 36 is in position 38 to distribute lubricant along the gauge face of rail 4, nozzle arm 10 is disposed generally vertically. Assuming that movement in the forward direction is represented by arrow 40, when nozzle arm 10 encounters an object in its path, it will rotate counterclockwise to position 42, whereupon connecting arm 18 and cam 20 will also rotate in a counterclockwise direction, forcing centering ball 32 against plate 30 and spring 28, whereupon centering ball 32 will enter the hollow channel of spring guide 22. When nozzle arm 10 has passed the object in its path, the force of spring 28 will operate on plate 30 and in turn on centering ball 32. Centering ball 32 will ride along the recess of cam 20, forcing cam 20 to return quickly, smoothly and efficiently to its generally vertical position, whereupon distribution of lubricant to the gauge face of rail 4 will again commence. It will be obvious from the foregoing, that the reverse will occur should nozzle arm 10 encounter an object in its path when the vehicle of the mobile lubricating system is traveling in a backward direction, whereupon nozzle arm 10 will move clockwise to position 43 and return to position 38 in a like manner.

From the foregoing, it is clear that the novel assembly for applying one or more materials to a rail of the present invention can easily negotiate objects in its path and return to the proper orientation for dispensing lubricant to the gauge face of rail 4, whether traveling backward or forward. Further, no operator intervention is necessary to ensure that nozzle arm 10 is not bent or otherwise damaged when negotiating objects in its path.

Figure 3:
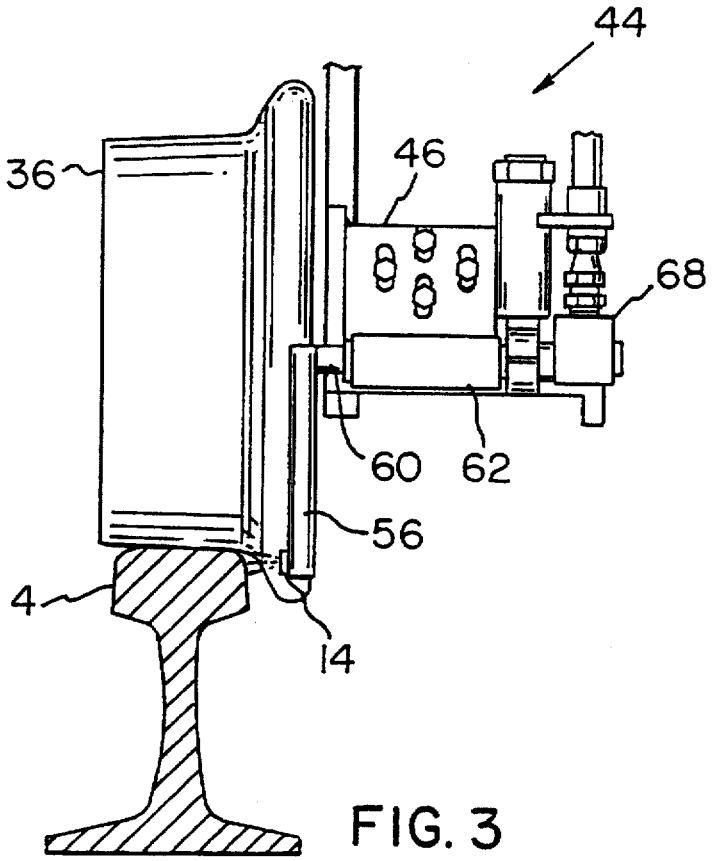
FIG. 3 is a front elevational view of a second embodiment of the assembly of the present invention.

An alternative embodiment of the present invention is shown in FIGS. 3–6. As above, for ease of discussion, it will be assumed the dispensed material is a lubricant although any material desired to be applied to the rail is within the scope of the present invention. As shown in FIG. 3, wheel 36 of a mobile unit is shown on rail 4 with material being applied via an assembly 44 for applying one or more materials to a rail. The assembly 44 differs from the assembly 1 as described below.

The assembly 44 includes mounting bracket 46. Mounting bracket 46 includes slots 48, 50, 52 and 54 to permit adjustment of the assembly 44 on the mobile unit as described in detail below.

The nozzle arm 56 of this embodiment includes discharge port 14 through which lubricant is applied to rail 4 perpendicular to the rail gauge face, however the end of nozzle arm 56 opposite discharge port 14 is formed significantly different from nozzle arm 10. Nozzle arm 56 shown in FIGS. 3 and 4 includes a hollow channel 58 disposed therein through which a lubricant can pass. As noted above, nozzle arm 56 also includes nozzle arm discharge port 14 located in fluid communication with nozzle arm channel 58 through which port 14 the lubricant passes and is dispensed on a rail surface.

A connecting arm 60 is retained on mounting bracket 46. Connecting arm 60 is retained in sleeve 62, but is permitted to pivot along its longitudinal axis while retained on the mounting bracket 46. A first end of connecting arm 60 is connected to nozzle arm 56 with the longitudinal axis of connecting arm 60 essentially perpendicular to the longitudinal axis of nozzle arm 56. In this embodiment, connecting arm 60 also includes a hollow channel 64 disposed along the longitudinal axis of connecting arm 60 through which the lubricant can pass, connecting arm channel 64 being in fluid communication with nozzle arm channel 58. The connecting arm channel 64 exits connecting arm 60 essentially perpendicular to said longitudinal axis of connecting arm 60 through an exit port 66 located generally at the end of connecting arm 60 opposite nozzle arm 56.

A swivel block 68 is associated with this second end of connecting arm 60. The swivel block 68 includes a through-hole therein with connecting arm 60 disposed within the through-hole, whereby swivel block 68 rotates about the longitudinal axis of connecting arm 60, including about exit port 66.

Swivel block 68 further includes a threaded hole 70 therein, the longitudinal axis of the threaded hole 70 essentially perpendicular to the longitudinal axis of the through-hole of swivel block 68. The longitudinal axis of threaded hole 70 aligns directly over exit port 66 when swivel block 68 is rotated about the longitudinal axis of connecting arm 60 to permit such alignment.

A fitting 72 threadably engages within threaded hole 70 of swivel block 68, said fitting 72 in fluid communication with connecting arm channel 64 and in turn nozzle arm channel 58 and in turn nozzle arm discharge port 14 when swivel block 68 is rotated about the longitudinal axis of connecting arm 60 to permit fitting 72 to align itself with exit port 66. It is to be noted that fitting 72 is not in fluid communication with connecting arm channel 64 when swivel block 68 is rotated about the longitudinal axis of connecting arm 60 such that fitting 72 is no longer in alignment with exit port 66. Fitting 72 is connected via hose 74 or the like to a lubricant supply source 17. Hose bracket 75 maintains parallel alignment between fitting 72 and mounting bracket 46. With this arrangement, lubricant will flow through connecting arm channel 64 only when nozzle arm 56 is in a plane substantially parallel with mounting bracket 46 and discharge port 14 is opposite the gauge face of rail 4. When nozzle arm 56 is displaced, as by an object in its path, regardless of whether the mobile lubricating unit is moving backward or forward along the rail, the flow of lubricant will immediately cease as fitting 72 and exit port 66 are not in alignment. When the object is traversed, in a manner described immediately below, nozzle arm 56 is returned to its original position, whereupon lubricant flow can then proceed due to the alignment of fitting 72 with exit port 66. In this manner, lubricant is applied only when desired and lubricant flow will automatically stop and correspondingly automatically resume as nozzle arm 56 passes over objects in its path and returns to its original position.

Figure 4:
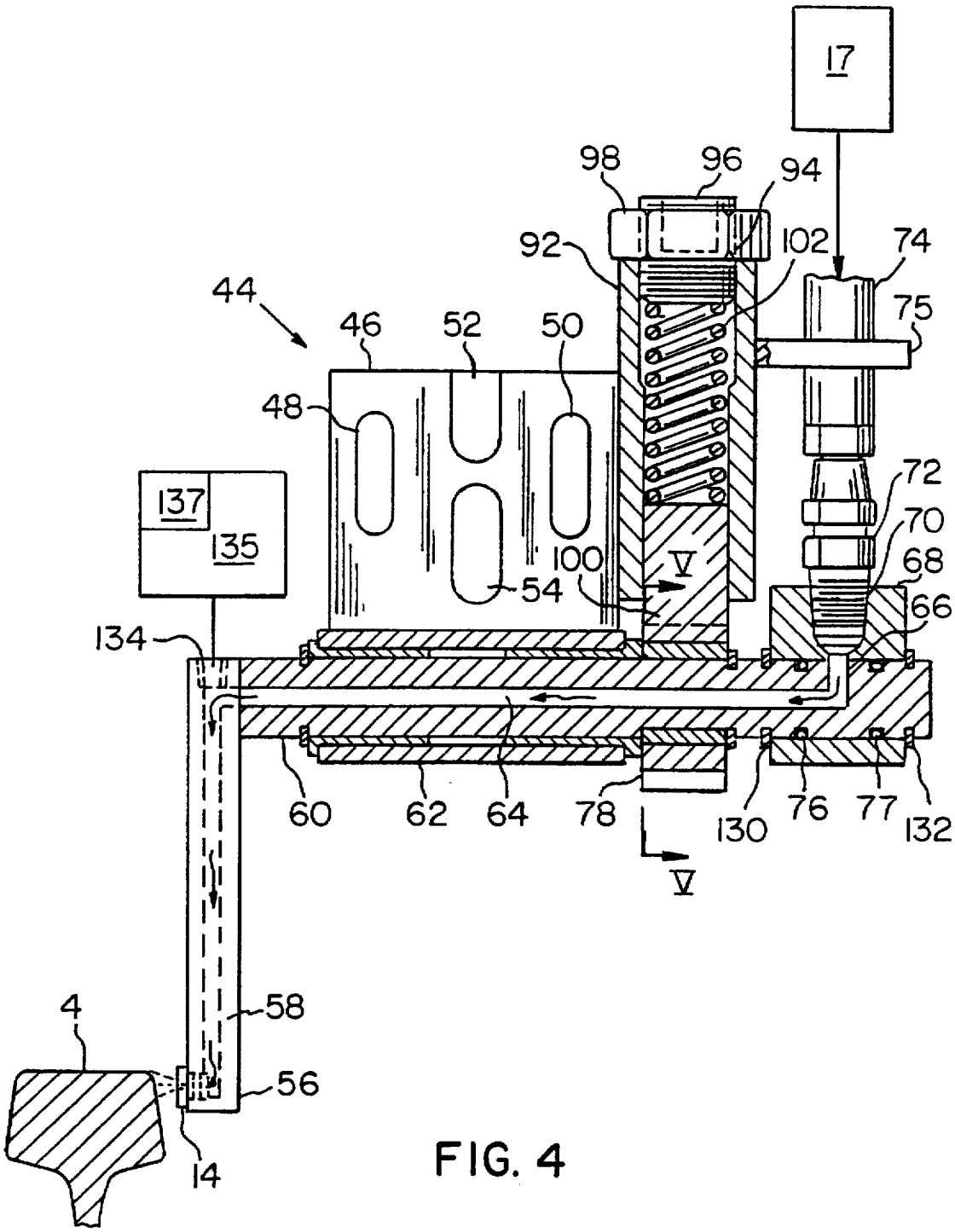
FIG. 4 is a side sectional view of the embodiment of FIG. 3.

In a preferred embodiment, as shown in FIG. 4, a seal between swivel block 68 and connecting arm 60 prevents lubricant from escaping through the through-hole of said swivel block 68 when fitting 72 and exit port 66 are not in alignment. The seal can take the form of 0-rings 76 and 77 in a preferred embodiment.

Figure 5:
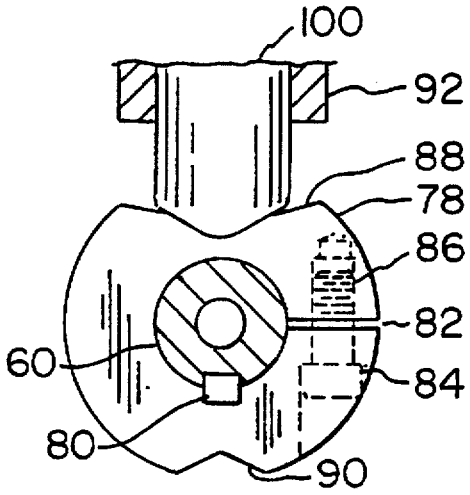
FIG. 5 is a sectional view along the line A—A of FIG. 4 showing the cam and detent.
Figure 6:
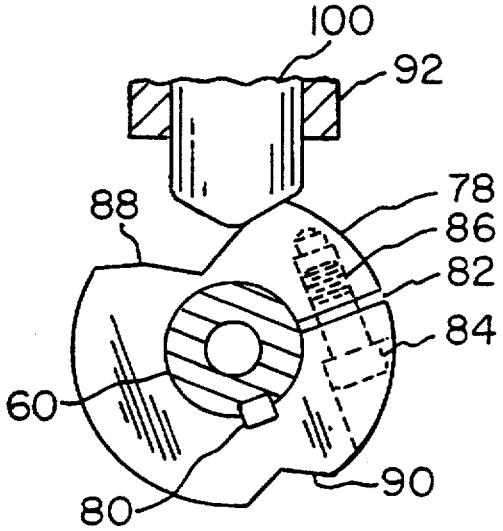
FIG. 6 is a sectional view of the cam of FIG. 5 showing displacement of the cam.

A cam 78 is associated with connecting arm 60. This association can take the form of machining or welding, but a preferred embodiment is shown in FIG. 5. As shown in FIG. 5, which is a section along the line A—A of FIG. 4, cam 78 is maintained on connecting arm 60 via a key 80 and keyway as is known in the art. In addition, cam 78 can be formed with split 82 which permits easy travel of cam 78 over connecting arm 60, but which can then be tightened with bolt 84 in blind threaded hole 86. Cam 78 is interposed on connecting arm 60 between sleeve 62 and swivel block 68. Cam 78 includes a first wedge shaped recess 88 therein as shown in FIGS. 5 and 6 and a second wedge shaped recess 90 opposed to the first recess along the periphery of cam 78.

A generally cylindrical spring guide 92 is retained on mounting bracket 46 as by welding or the like. The longitudinal axis of spring guide 92 is positioned directly vertically above first recess 88 and essentially perpendicular to the longitudinal axis of connecting arm 60. One end of spring guide 92 includes threads 94 into which a spring tension adjuster 96 is threadably engaged. The spring tension adjuster 96 may take the form of a bolt having an allen head, and may further include lock nut 98 which threadably engages the threads on the exterior of spring tension adjuster 96 which upon tightening forces itself down upon the top of spring guide 92 to prevent unwanted travel of spring tension adjuster 96.

A tapered rod or detent 100 is located within spring guide 92, the longitudinal axis of the rod 100 being positioned parallel with the longitudinal axis of spring guide 92. The rod 100 is disposed to slide within spring guide 92 along the longitudinal axis of spring guide 92. The tapered portion of rod 100 is disposed to engage the first recess 88 as rod 100 slides within spring guide 92.

A generally cylindrical spring 102 is located within spring guide 92. The longitudinal axis of spring 102 is parallel to the longitudinal axis of spring guide 92, said spring 102 being interposed between rod 100 and spring tension adjuster 96. Spring 102 operates to urge rod 100 toward first recess 88, as shown in FIG. 5. As shown in FIG. 6, as nozzle arm 56 is rotated about its point of attachment to connecting arm 60, from a first position to a second position by a force, such as an object in the path of nozzle arm 56 as it travels along rail 4, connecting arm 60 is in turn rotated and cam 78 is in turn rotated, whereupon rod 100 travels along first recess 88, moving rod 100 upward within spring guide 92, whereupon rod 100 compresses spring 102. Swivel block 68 is held in position by hose bracket 75, hose 74 and fitting 72 and remains in its original position, but connecting arm 60 rotates upon its longitudinal axis preventing alignment of fitting 72 and exit port 66, thereby interrupting a flow of said lubricant. On the other hand, when the force acting on nozzle arm 56 is removed, spring 102 uncompresses pressing rod 100 downward, whereupon rod 100 travels along first recess 88 of cam 78, and in turn rotating cam 78 to its original position, which in turn rotates connecting arm 60, which in turn rotates nozzle arm 56, returning nozzle arm 56 from its second position to its first position. As connecting arm 60 rotates to its original position, swivel block 68 returns to the alignment of fitting 72 with exit port 66, whereupon a flow of lubricant resumes.

Second recess 90 functions to provide a stowed position for travel for assembly 44 for applying one or more materials to a rail. In this position, nozzle arm 56 is rotated manually about its point of attachment to connecting arm 60 to the point where rod 100 engages second recess 90. The assembly is safely stowed in this position for travel. It should be noted that the lubricant supply is also interrupted in this position due to the fact that fitting 72 and exit port 66 are no longer in alignment.

Figure 7:
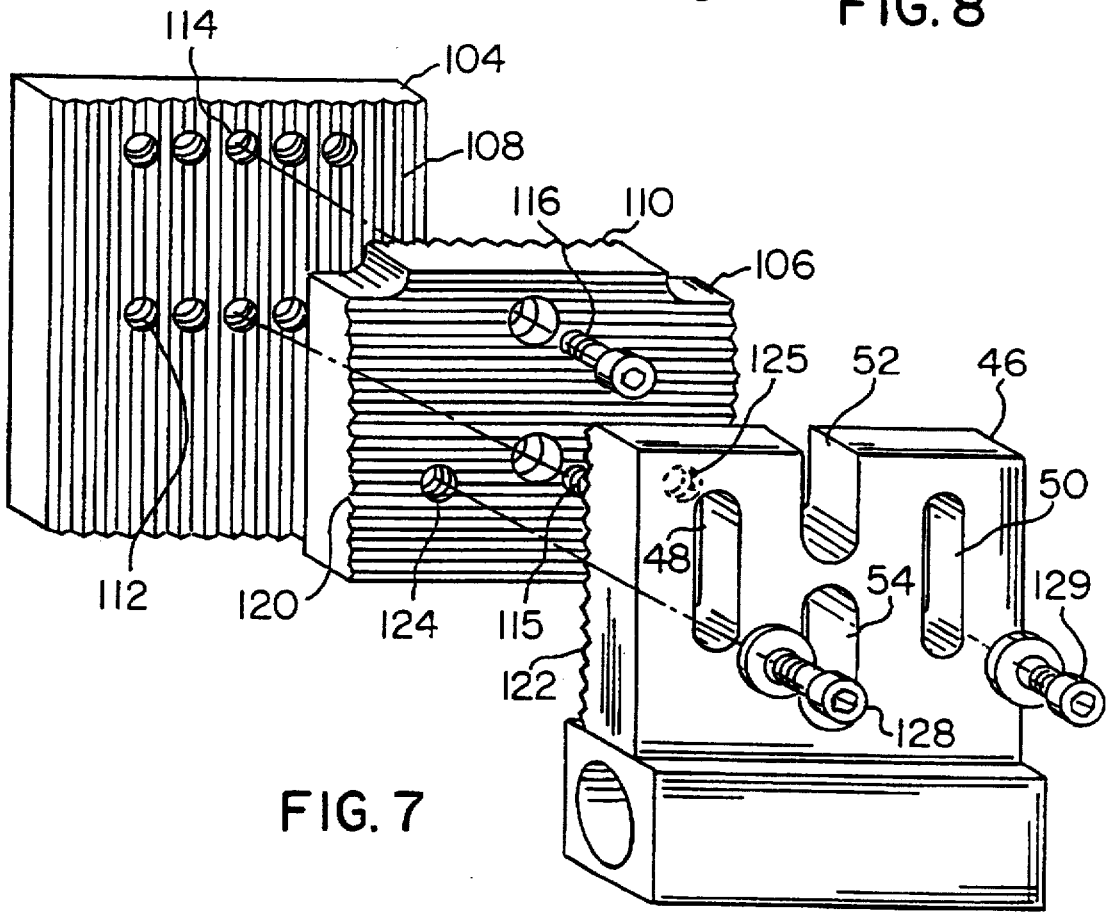
FIG. 7 is an exploded view of a mounting system for the assembly of the present invention to vehicle rail gear allowing both vertical and horizontal adjustment of the nozzle assembly.

While mounting bracket 46 could be mounted directly to the rail gear as by welding, bolting or the like, a preferred mounting system is shown in FIG. 7. In this preferred embodiment, a rail gear bracket 104 is preferably mounted to the vehicle's rail gear as by welding, bolting or the like. Mounting bracket 46 is mounted to rail gear bracket 104 with spacer 106 interposed therebetween.

Horizontal adjustment of mounting bracket 46 is accomplished with a plurality of vertical serrations 108 on the face of rail gear bracket 104 in contact with spacer 106, which engage a plurality of vertical serrations 110 on spacer 106. A plurality of spaced threaded holes 112 and 114 in rail gear bracket 104 permit spacer 106 to be shifted horizontally left or right, in turn shifting mounting bracket 46 horizontally left or right as required for adjustment, whereupon serrations 108 and 110 and bolts 115 and 116 which pass through slots 54 and 52 in mounting bracket 46 maintain the desired adjustment upon tightening.

Vertical adjustment of mounting bracket 46 is accomplished through a plurality of horizontal serrations 120 on the face of spacer 106 in contact with mounting bracket 46, which in turn engage a plurality of serrations 122 on the corresponding face of mounting bracket 46. A pair of threaded holes 124 (shown) and 125 (shown in phantom) in spacer 106 cooperating with slots 48 and 50 in mounting bracket 46 permit mounting bracket 46 to be shifted vertically up and down as required for adjustment, whereupon serrations 120 and 122 and bolts 128 and 129 in slots 48 and 50 of mounting bracket 46 maintain the desired adjustment upon tightening.

Referring now to FIG. 4, in a preferred embodiment of the present invention, swivel block 68 is maintained in proper orientation along the length of connecting arm 60 with snap rings 130 and 132 which engage snap ring channels in connecting arm 60 as is commonly known in the art.

Also as shown in FIG. 4, in a preferred embodiment, nozzle arm 56 is also fitted with port 134 which is in fluid communication with nozzle arm channel 58. Port 134 can be fitted with a removable plug permitting easy access to clean and inspect nozzle arm channel 58. In an alternative embodiment of the present invention, port 134 can be adapted to accept a pressure sensor or volume flow sensor, shown schematically as 135 in FIG. 4, which is in turn adapted to provide a remote readout (by portion 137 shown schematically in FIG. 4) to the driver of the vehicle to keep the driver informed of the pressure or the flow rate of lubricant through nozzle arm channel 58.

It should also be noted that discharge port 14 on either nozzle arm 10 or nozzle arm 56 is in a preferred embodiment of the present invention, threadably engaged to nozzle arm 10 or 56 to permit easy removal of discharge port 14 for repair of the assembly, cleaning of the respective nozzle arm channels and the like. Further, discharge port 14 can be provided with orifices of different diameters to allow for greater or lesser flow of lubricant therethrough. In this way, users of the present invention can select, specify or simply be provided with a set or series of discharge ports 14 with orifices of various diameters permitting greater control of lubricant flow to the rail.

Figure 8:
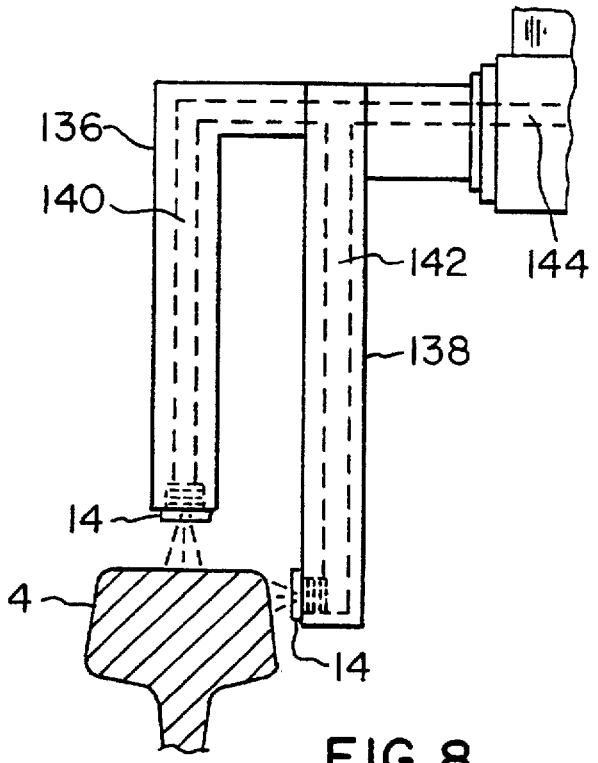
FIG. 8 is a side sectional view of the assembly of the present invention showing a pair of nozzles which can dispense materials on both the gauge face and top of the rail simultaneously or independently.

In still another embodiment of the present invention, as shown in FIG. 8, the nozzle arm can be formulated as a pair of nozzle arms 136 and 138 with respective nozzle arm channels 140 and 142 which are both in fluid communication with connecting arm channel 144 shown in FIG. 8, permitting simultaneous lubrication of both the gauge face and the top of rail 4 through a pair of discharge ports 14. In an embodiment not shown, nozzle arm channels 140 and/or 142 can be each fitted with a flow control valve to permit independent lubrication of either the top of rail 4 or the gauge face of rail 4 or both simultaneously. Also in an embodiment not shown, where nozzle arm channels 140 and 142 are not in fluid communication with nozzle arm channel 144, but are in fluid communication with a fitting similar to the configuration as shown in FIG. 1 but with a pair of nozzle arms 136 and 138, a single fitting can be used to supply both nozzle arm channels 140 and 142. Alternatively, each nozzle arm channel 140 and 142 could be formulated in fluid communication with its own fitting such as fitting 16, whereupon different materials such as lubricants, anti-slip materials or friction modifiers may be simultaneously or independently supplied to either the top of the rail or the gauge face, respectively as desired for a given application.

Figure 9:
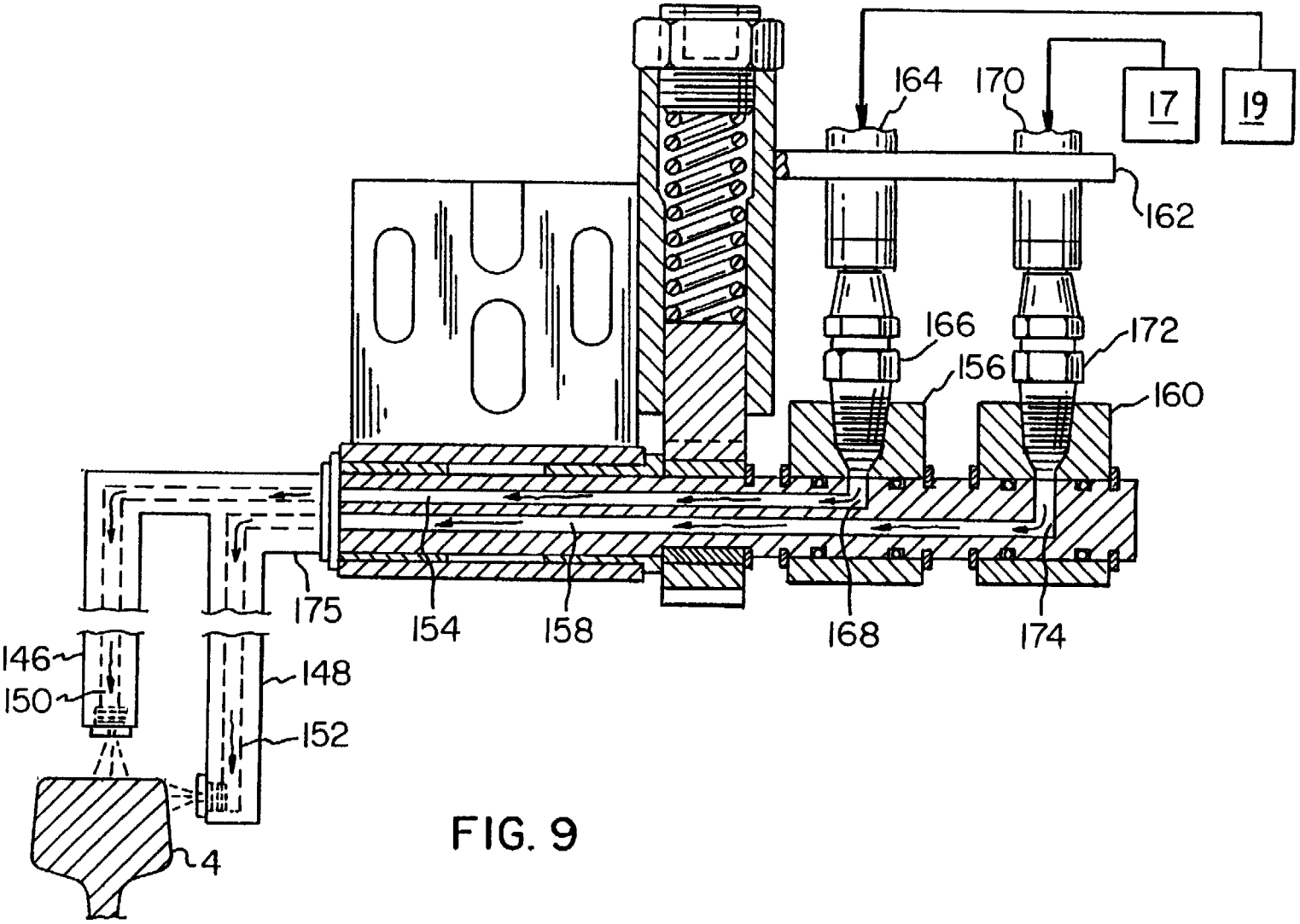
FIG. 9 is a side sectional view of the assembly of the present invention showing a pair of nozzles in fluid communication with a pair of respective swivel blocks which can apply different materials to the top of the rail and the rail gauge face simultaneously or independently.

In yet another embodiment of the present invention, as shown in FIG. 9, a pair of nozzle arms 146 and 148 are shown which include nozzle arm channels 150 and 152, therein. Nozzle arm channel 150 is in fluid communication with a first connecting arm channel 154, which is in turn in fluid communication with a first swivel block 156, which is identical in form and function to that already described. Nozzle arm channel 152 is in fluid communication with a second connecting arm channel 158 which is in turn in fluid communication with a second swivel block 160, which is also identical in form and function to that already described. In this embodiment, as shown in FIG. 9, hose bracket 162 is somewhat longer than hose bracket 76 of FIG. 4 to accommodate a first hose 164 which is in fluid communication with first connecting arm channel 154 upon proper alignment of first fitting 166 with first exit port 168. Similarly, second hose 170 is in fluid communication with second connecting arm channel 158 upon proper alignment of second fitting 172 with second exit port 174. Connecting arm 175 of FIG. 9 is slightly longer than connecting arm 60 of FIG. 4 to accommodate second swivel block 160. Also, connecting arm 175 obviously includes two connecting arm channels as opposed to the single connecting arm channel 64 of connecting arm 60 of FIG. 4. In the embodiment of FIG. 9, two different materials from sources 17 and 19 can each be applied to the top of the rail surface and to the rail gauge face of rail 4. These materials can include a lubricant, a friction modifier, a rail cleaner or degreaser or any fluid or fluid-like material desired to be applied to the rail. For example, a lubricant may be applied to the gauge face of rail 4 while a friction modifier is applied to the top surface of rail 4. A friction modifier slightly reduces the frictional force between rail 4 and the railed vehicles traveling over the rail 4, but is not nearly as lubricous, permitting some traction to exist. As another example, a lubricant may be applied to the gauge face of rail 4 while an anti-slip material is applied to the top of rail 4 to provide sufficient frictional force on the top surface of the rail so as to permit the railed vehicles to travel over the rail, while lubricating the flanges of the rail wheels to reduce wear and noise. In an embodiment not shown, nozzle arm channels 150 and/or 152 can be each fitted with a flow control valve to permit independent lubrication of either the top of rail 4 or the gauge face of rail 4 or both simultaneously. Also, in an embodiment not shown, nozzle arm channels 150 and 152 can each be fitted with a port similar to port 134 of FIG. 4 to provide the benefits above described with respect to port 134.

Figure 10:
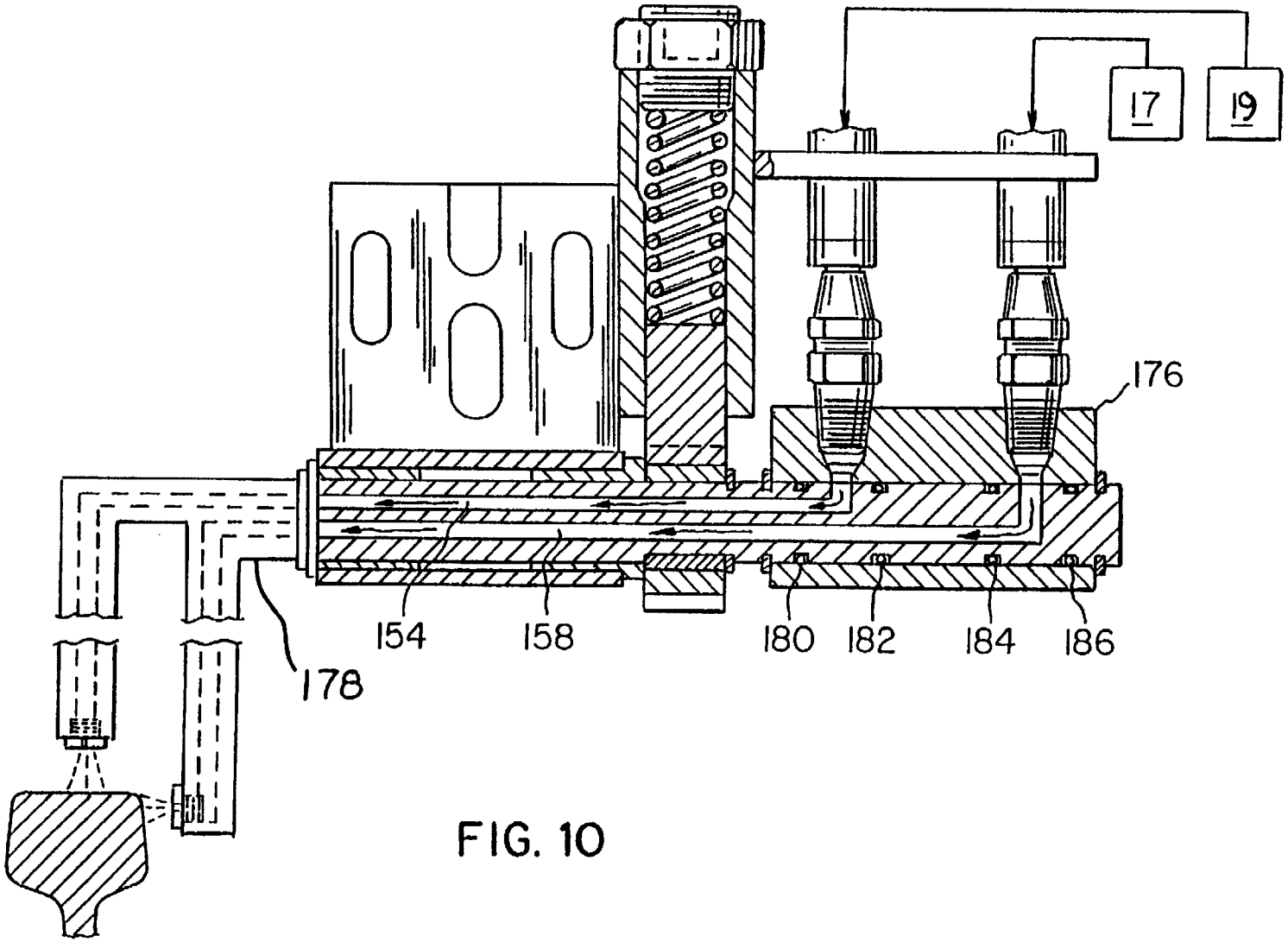
FIG. 10 is a side sectional view of the embodiment of FIG. 9 showing a single swivel block.

An alternative embodiment is shown in FIG. 10, which is identical to FIG. 9 except that swivel blocks 156 and 160 of FIG. 9 have been replaced in FIG. 10 with a single swivel block 176. Intermixing or contamination of the flows of materials through first connecting channel 154 and second connecting channel 158 through leakage along connecting arm 178 is prevented by seals, as shown in FIG. 10. In a preferred embodiment these seals take the form of O-rings 180, 182, 184 and 186 as shown in FIG. 10. While swivel block 176 is slightly different in form than those previously described, it is identical in function.

While different embodiments of the invention are shown and described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

We claim:

1. An assembly for applying one or more materials to a rail comprising:

a) a mounting bracket for mounting said assembly to a vehicle adapted to travel on said rail;

b) a connecting arm having a first and second end, said connecting arm coupled to said mounting bracket;

c) at least one nozzle arm connected to said first end of said connecting arm, said nozzle arm further including a hollow channel disposed therein through which a material to be applied to a rail surface from a material supply source flows;

d) a nozzle port in fluid communication with said nozzle arm channel and spaced from said rail through which the material flows and is dispensed on the rail surface when said nozzle arm is in an operative position; and e) a means for biasing said nozzle arm toward said operative position which is spaced from said rail, whereby said nozzle arm is adapted to move away from said operative position in response to contact with obstructions and is returned by said biasing means to said operative position following the contact, wherein said nozzle arm is movable to a stowed position.

2. The assembly of claim 1, wherein said biasing means is coupled to said connecting arm.

3. The assembly of claim 1, wherein said nozzle port is removably attached to said nozzle arm.

4. The assembly of claim 1 further comprising a means to interrupt said flow of said material when said nozzle arm is not in said operative position.

5. The assembly of claim 1, wherein said nozzle port is positioned below a top surface of the rail substantially perpendicular to a rail gauge face when said nozzle arm is in said operative position.

6. The assembly of claim 1, wherein said material is at least one of the compounds selected from the group consisting of lubricants, anti-slip compounds, rail cleaners and rail degreasers.

7. The assembly of claim 1 further comprising a pair of said nozzle arms.

8. The assembly of claim 7, wherein said pair of nozzle arms are in fluid communication with said material supply source.

9. The assembly of claim 7, wherein a first of said pair of nozzle arms is in fluid communication with a first material supply source and a second of said pair of nozzle arms is in fluid communication with a second material supply source.

10. An assembly for applying one or more materials to a rail comprising:

a) a mounting bracket for mounting said assembly to a vehicle adapted to travel on said rail;

b) a connecting arm having a first end and a second end, said connecting arm coupled to said mounting bracket;

c) at least one nozzle arm connected to said first end of said connecting arm, said nozzle arm further including a hollow channel disposed therein through which a material to be applied to a rail surface from a material supply source flows;

d) a nozzle port in fluid communication with said nozzle arm channel through which said port the material flows and is dispensed on the rail surface when said nozzle arm is in an operative position; and e) a means for biasing said nozzle arm toward said operative position, whereby said nozzle arm is adapted to move away from said operative position in response to contact with obstructions and is returned to said operative position by said biasing means following the contact, wherein said biasing means includes a cam including a recess for accepting a detent therein.

11. The assembly of claim 10, wherein said detent is in the form of a tapered rod.

12. The assembly of claim 10, wherein said detent is urged toward said recess by a spring.

13. The assembly of claim 12 further including a spring tension adjuster to adjust the force of said spring acting on said detent.

14. An assembly for applying one or more materials to a rail comprising:

a) a mounting bracket for mounting said assembly to a vehicle adapted to travel on said rail;

b) a connecting arm having a first end and a second end, said connecting arm coupled to said mounting bracket;

c) at least one nozzle arm connected to said first end of said connecting arm, said nozzle arm further including a hollow channel disposed therein through which a material to be applied to a rail surface from a material supply source flows;

d) a nozzle port in fluid communication with said nozzle arm channel and spaced from the rail through which the material flows and is dispensed on the rail surface when said nozzle arm is in an operative position; and e) a means for biasing said nozzle arm toward said operative position which is spaced from the rail, whereby said nozzle arm is adapted to move away from said operative position in response to contact with obstructions and is returned to said operative position by said biasing means following the contact, wherein said nozzle port is removably attached to said nozzle arm and, wherein said nozzle port is threadably attached to said nozzle arm.

15. An assembly for applying one or more materials to a rail comprising:

a) a mounting bracket for mounting said assembly to a vehicle adapted to travel on said rail;

b) a connecting arm having a first end and a second end, said connecting arm coupled to said mounting bracket;

c) at least one nozzle arm connected to said first end of said connecting arm, said nozzle arm further including a hollow channel disposed therein through which a material to be applied to a rail surface from a material supply source flows;

d) a nozzle port in fluid communication with said nozzle arm channel through which the material flows and is dispensed on the rail surface when said nozzle arm is in an operative position; and e) a means for biasing said nozzle arm toward said operative position, whereby said nozzle arm is adapted to move away from said operative position in response to contact with obstructions and is returned to said operative position by said biasing means following the contact, further comprising a means to interrupt said flow of said material when said nozzle arm is not in said operative position, wherein said means to interrupt said flow of said material includes said connecting arm and at least one swivel block in fluid communication with said material supply source, said swivel block coupled with said connecting arm so as to permit rotation of said swivel block about said connecting arm, wherein said swivel block is in fluid communication with a hollow channel disposed within said connecting arm only when said nozzle arm is in said operative position, whereupon the material flows from the material supply source through said swivel block, through said hollow channel disposed within said connecting arm, through said hollow channel of said nozzle arm, said hollow channel of said nozzle arm in fluid communication with said hollow channel of said connecting arm, whereupon the material flows through said nozzle port and is dispensed upon said rail only when said nozzle arm is in said operative position.

16. An assembly for applying one or more materials to a rail comprising:

a) a mounting bracket for mounting said assembly to a vehicle adapted to travel on said rail;

b) a connecting arm having a first end and a second end, said connecting arm coupled to said mounting bracket;

c) at least one nozzle arm connected to said first end of said connecting arm, said nozzle arm further including a hollow channel disposed therein through which a material to be applied to a rail surface from a material supply source flows;

d) a nozzle port in fluid communication with said nozzle arm channel through which the material flows and is dispensed on the rail surface when said nozzle arm is in an operative position; and e) a means for biasing said nozzle arm toward said operative position, whereby said nozzle arm is adapted to move away from said operative position in response to contact with obstructions and is returned to said operative position by said biasing means following the contact, wherein said mounting bracket further includes a rail gear bracket and a spacer interposed between said mounting bracket and said rail gear bracket.

17. The assembly of claim 16, wherein each of said rail gear bracket and said spacer further includes corresponding vertical serrations on corresponding faces of each of said rail gear bracket and said spacer where said rail gear bracket and said spacer contact to permit horizontal adjustment of said mounting bracket.

18. The assembly of claim 16, wherein each of said mounting bracket and said spacer further includes corresponding horizontal serrations on corresponding faces of each of said mounting bracket and said spacer where said mounting bracket and said spacer contact to permit vertical adjustment of said mounting bracket.

19. An assembly for applying one or more materials to a rail comprising:

a) a means for mounting said assembly to a vehicle adapted to travel on said rail, said means including a mounting bracket, said mounting bracket including a sleeve;

b) at least one nozzle arm, said nozzle arm having a first end and a second end, said nozzle arm further including along a longitudinal axis of said nozzle arm a hollow channel disposed therein through which the material can flow;

c) one or more nozzle arm ports located at said first end of said nozzle arm in fluid communication with said nozzle arm channel through which said material flows and is dispensed on a rail surface;

d) a connecting arm retained on said mounting bracket within said sleeve, and wherein said connecting arm is permitted to pivot along its longitudinal axis while retained within said sleeve, said connecting arm having a first end and a second end, wherein said first end of said connecting arm is connected to said second end of said nozzle arm with said longitudinal axis of said connecting arm essentially perpendicular to said longitudinal axis of said nozzle arm, and wherein said connecting arm includes a hollow channel therein disposed along said longitudinal axis of said connecting arm through which said material flows, said connecting arm channel being in fluid communication with said nozzle arm channel at said first end of said connecting arm, said connecting arm channel exiting said connecting arm essentially perpendicular to said longitudinal axis of said connecting arm through an exit port located generally at said second end of said connecting arm;

e) a swivel block associated with said second end of said connecting arm, said swivel block including a through-hole therein, wherein said second end of said connecting arm is disposed within said through-hole whereby said swivel block rotates about said longitudinal axis of said connecting arm including about said exit port of said connecting arm channel, said swivel block further including a threaded hole therein, the longitudinal axis of said threaded hole essentially perpendicular to said longitudinal axis of said through-hole, said longitudinal axis of said threaded hole aligned over said exit port when said swivel block is rotated about said longitudinal axis of said connecting arm to permit such alignment;

f) a fitting threadably engaged within said threaded hole of said swivel block, said fitting in fluid communication with said connecting arm channel and in turn said nozzle arm channel and in turn said nozzle arm port when said swivel block is rotated about said longitudinal axis of said connecting arm to permit said alignment, said fitting not in fluid communication with said connecting arm channel when said swivel block is rotated about said longitudinal axis of said connecting arm such that said swivel block is not in said alignment, said fitting in fluid communication with a material supply source;

g) a means for sealing between said swivel block and said connecting arm;

h) a cam mounted on said connecting arm, said cam being interposed between said sleeve and said swivel block, said cam including a first recess therein and a second recess opposed to said first recess along the periphery of said cam;

i) a spring guide retained on said mounting bracket, the longitudinal axis of said spring guide positioned directly vertically above said first recess and essentially perpendicular to said longitudinal axis of said connecting arm, said spring guide having a first end and a second end, wherein said second end of said spring guide is closest to said first recess and said first end of said spring guide is furthest from said first recess, said first end of said spring guide having threads contained therein;

j) a spring tension adjuster, wherein said spring tension adjuster threadably engages said threads in said spring guide;

k) a detent, said detent in the form of a tapered rod located within said spring guide, the longitudinal axis of said rod being positioned parallel with said longitudinal axis of said spring guide, said rod being disposed to slide within said spring guide along said longitudinal axis of said spring guide and said tapered portion of said rod disposed to engage said first recess as said rod slides within said spring guide; and l) a spring located within said spring guide, the longitudinal axis of said spring being parallel to said longitudinal axis of said spring guide, said spring being interposed between said rod and said spring tension adjuster and operating to urge said rod toward said first recess.

20. The assembly of claim 19, wherein said means for sealing includes at least one O-ring.

21. The assembly of claim 19, wherein as said nozzle arm is rotated about its point of attachment to said connecting arm from a first position to a second position by a force, said connecting arm is in turn rotated about said longitudinal axis of said connecting arm and said cam is in turn rotated, whereupon said rod travels along said first recess and is thereby urged toward said spring guide whereupon said rod compresses said spring, and wherein said swivel block is maintained in a first position relative to said connecting arm whereupon said exit port rotates relative to said swivel block as said connecting arm is rotated preventing said alignment and interrupting a flow of said material and whereupon when said force is removed, said spring uncompresses returning said rod along said first recess of said cam and in turn rotating said cam, which in turn rotates said connecting arm, which in turn rotates said nozzle arm, returning said nozzle arm from said second position to said first position, and whereupon said exit port rotates relative to said swivel block and returns to said alignment whereupon a flow of said material resumes.

22. The assembly of claim 19, wherein said nozzle port is perpendicular to said rail surface.

23. The assembly of claim 19, wherein said rail surface is a rail gauge face.

24. The assembly of claim 19, wherein said assembly includes a pair of nozzle arms associated with said connecting arm, wherein said pair of nozzle arms are in fluid communication with said hollow channel of said connecting arm, wherein a first of said nozzle arms dispenses a material on a top of said rail surface and a second of said nozzle arms dispenses a material on a gauge face of said rail surface.

25. The assembly of claim 19, wherein said assembly includes:

a) said connecting arm, wherein said connecting arm further includes a pair of connecting arm channels;

b) a pair of nozzle arms, a first of said nozzle arms including a nozzle arm channel in fluid communication with a first of said pair of connecting arm channels, wherein said first nozzle arm disperses a first material to a top of said rail surface and a second of said nozzle arms including a nozzle arm channel in fluid communication with a second of said pair of connecting arm channels, wherein said second nozzle arm disperses a second material to a rail gauge face; and c) a pair of said swivel blocks, a first of said swivel blocks in fluid communication with said first connecting arm channel and a second of said swivel blocks in fluid communication with said second connecting arm channel.

26. The assembly of claim 25, wherein said first material is a friction modifier and, wherein said second material is a lubricant.

27. The assembly of claim 19, wherein said nozzle arm further includes a second port at said second end of said nozzle arm, said second port in fluid communication with said nozzle arm channel.

28. The assembly of claim 27, wherein said second port further includes a sensor for measuring material pressure.

29. The assembly of claim 28, wherein said sensor further includes a means for providing a remote readout of said pressure.

30. The assembly of claim 19, wherein said material is at least one of the compounds selected from the group consisting of lubricants, anti-slip compounds, rail cleaners and rail degreasers.

31. An assembly for applying one or more materials to a rail comprising:

a) a means for mounting said assembly to a vehicle adapted to travel on said rail, said means including a mounting bracket, said mounting bracket including a sleeve;

b) a nozzle arm having a first end and a second end, said nozzle arm further including along a longitudinal axis of said nozzle arm a hollow channel disposed therein through which the material can flow;

c) at least one nozzle port located at said first end of said nozzle arm in fluid communication with said channel in said nozzle arm through which said port said material flows and is dispensed on a rail surface;

d) a connecting arm retained on said mounting bracket within said sleeve and, wherein said connecting arm is permitted to pivot along its longitudinal axis while retained within said sleeve, said connecting arm having a first end and a second end, wherein said first end of said connecting arm is associated with said nozzle arm and said second end of said connecting arm is associated with a cam, said cam including a recess therein for accepting a detent;

e) a spring guide retained on said mounting bracket, the longitudinal axis of said spring guide positioned above said detent and essentially perpendicular to said longitudinal axis of said connecting arm, said spring guide having a first and second end, wherein said second end of said spring guide is closest to said recess and said first end of said spring guide is furthest from said recess, said first end of said spring guide having threads contained therein;

f) a spring tension adjuster, wherein said spring tension adjuster threadably engages said threads in said spring guide;

g) a plate located within said spring guide, said plate being positioned essentially perpendicular to said longitudinal axis of said spring guide and disposed to slide within said spring guide along said longitudinal axis of said spring guide;

h) a spring located within said spring guide and having a longitudinal axis parallel to said longitudinal axis of said spring guide, said spring being interposed between said plate and said spring tension adjuster and operating to urge said plate toward said recess; and i) a detent in the form of a centering ball, said centering ball being disposed between said plate and said recess of said cam.

32. The assembly of claim 31, wherein as said nozzle arm is rotated about its point of attachment to said connecting arm from a first position to a second position by a force, said connecting arm is in turn rotated about said longitudinal axis of said connecting arm and said cam is in turn rotated, whereupon said centering ball travels along said recess in said cam toward said spring guide compressing said spring and whereupon when said force is removed, said spring uncompresses returning said centering ball along said recess of said cam and in turn rotating said cam, which in turn rotates said connecting arm, which in turn rotates said nozzle arm, returning said nozzle arm from said second position to said first position.

33. The assembly of claim 31, wherein said rail surface is a rail gauge face.

* * * * *